US005617968A

United States Patent [19]

Luburic

[11] Patent Number: 5,617,968

[45] Date of Patent: Apr. 8, 1997

[54] CONTAINER COVER HAVING PRIMARY AND SECONDARY DETENT MEANS

[75] Inventor: Frano Luburic, Fullerton, Calif.

[73] Assignee: Ropak Corporation, Fullerton, Calif.

[21] Appl. No.: 538,835

[22] Filed: Oct. 4, 1995

Related U.S. Application Data

[63] Continuation of Ser. No. 125,123, Sep. 22, 1993, abandoned.

[51] Int. Cl.[6] ..... B65D 17/40

[52] U.S. Cl. ..... 220/276; 220/266

[58] Field of Search ..... 220/266, 276, 220/306, 346, 351, 356

[56] References Cited

U.S. PATENT DOCUMENTS

| | | | |
|---|---|---|---|
| 3,037,672 | 6/1962 | Gach | 220/266 X |
| 4,607,759 | 8/1986 | Boetzkes | 220/266 |
| 4,646,926 | 3/1987 | Agbay et al. | 220/266 X |
| 4,660,735 | 4/1987 | Peschardt et al. | 220/276 |
| 4,735,337 | 4/1988 | Von Holdt . | |
| 4,790,448 | 12/1988 | Ostrum et al. | 220/276 X |
| 4,819,824 | 4/1989 | Longbottom et al. | 220/266 |
| 4,930,656 | 6/1990 | Blanchette . | |
| 4,934,554 | 6/1990 | Edwards | 220/266 |
| 5,238,135 | 8/1993 | Landis . | |
| 5,249,694 | 10/1993 | Nelson | 220/306 X |
| 5,271,517 | 12/1993 | Bowers | 220/276 |

*Primary Examiner*—Steven M. Pollard
*Attorney, Agent, or Firm*—J. Mark Holland

[57] ABSTRACT

A cover for a container is provided with primary and secondary detent means, the primary detent means being mounted on a tamper-evident tear strip and being removable with the tear strip as opening of the cover is desired. Secondary detent means is provided on detent tabs which remain operatively associated with the cover. The limited engagement of the detent tabs with the retaining means of the cover results in facile removal of the cover from operative engagement with the container and the reinstallation and the corresponding and facile reinstallation of the cover upon the container.

15 Claims, 5 Drawing Sheets

CONTAINER COVER HAVING PRIMARY AND SECONDARY DETENT MEANS

This application is a continuation of application Ser. No. 08/125,123, filed on Sep. 22, 1993, now abandoned.

This invention relates to a container cover and, more particularly, to a container cover for containers having cover retaining means on the upper extremities thereof, said container cover having primary and secondary detent means thereupon for engaging said cover retaining means on said container. The cover incorporates tamper indicating means which has said primary detent means operatively associated therewith.

BACKGROUND OF THE INVENTION

Covers having tamper indicating means are well known in the art and have become more widely utilized because of numerous incidents of tampering with the contents of conventional containers, particularly in the drug and comestible fields. Such tamper indicating means can be provided in the form of container seals, tear strips, or the like.

Conventional tear strips are usually provided on covers fabricated from synthetic plastics such as linear polyethylene and are so located on the container that they prevent the opening of the cover until the tear strip is severed from the cover to permit it to be exposed for easy opening.

Conventional tear strips are usually provided in injection molded covers by the provision of a finger grip and a score line which defines the portion of the cover which will be removed by the tear strip action. The score line is provided on the interior of the cover during the injection molding process.

After the tear strip has been removed, sufficient access to the remaining portion of the cover can be had to remove the cover from operative relationship with the retaining means of the cover.

However, after the tear strip has been removed, some covers tend to be difficult to release from the associated container since the relationship between the retaining means of the container and the detent means of the cover tends to cause binding between retaining means and detent means. The cover of the invention eliminates this problem by removing the primary detent means and making the cover "user friendly."

OBJECTS AND ADVANTAGES OF THE INVENTION

An object of the invention is the provision of a cover for a container wherein the container is provided with cover retaining means on its upper extremity and said cover incorporates primary and secondary detent means engagable with said retaining means to initially maintain said cover in operative relationship with said container.

Another object of the invention is the provision of a cover of the aforementioned type in which said first and second detent means are provided on the depending skirt of the cover and engage the retaining means of the container.

An additional object of the invention is the provision of a cover of the aforementioned character in which said primary and secondary detent means are provided on different portions of the cover, one portion of the cover incorporating said primary detent means being removable from operative relationship with the cover and simultaneously removing the primary detent means associated therewith while the secondary detent means on the other portion of the cover remains in operative relationship with the retaining means of the container.

An associated object of the invention is the provision of a cover of the aforementioned character with a skirt in which the one portion of the skirt of the cover which incorporates said primary detent means is provided in the form of a tear strip, said tear strip, when removed from operative relationship with the cover, simultaneously removing the primary detent means from operative engagement with the retaining means of the cover thus facilitating, in a manner to be described in greater detail below, the facile removal of the cover from operative relationship with the container.

A further object of the invention is the provision of a cover of the aforementioned type in which the secondary detent means is provided on depending tabs formed in the skirt, said secondary detent means remaining in operative engagement with the retaining means of the cover after the aforesaid tear strip has been removed from operative relationship therewith.

Other objects and advantages of the invention will be apparent from the following specification and the drawings.

DESCRIPTION OF PREFERRED EMBODIMENT OF THE INVENTION

Figures 1, 7:
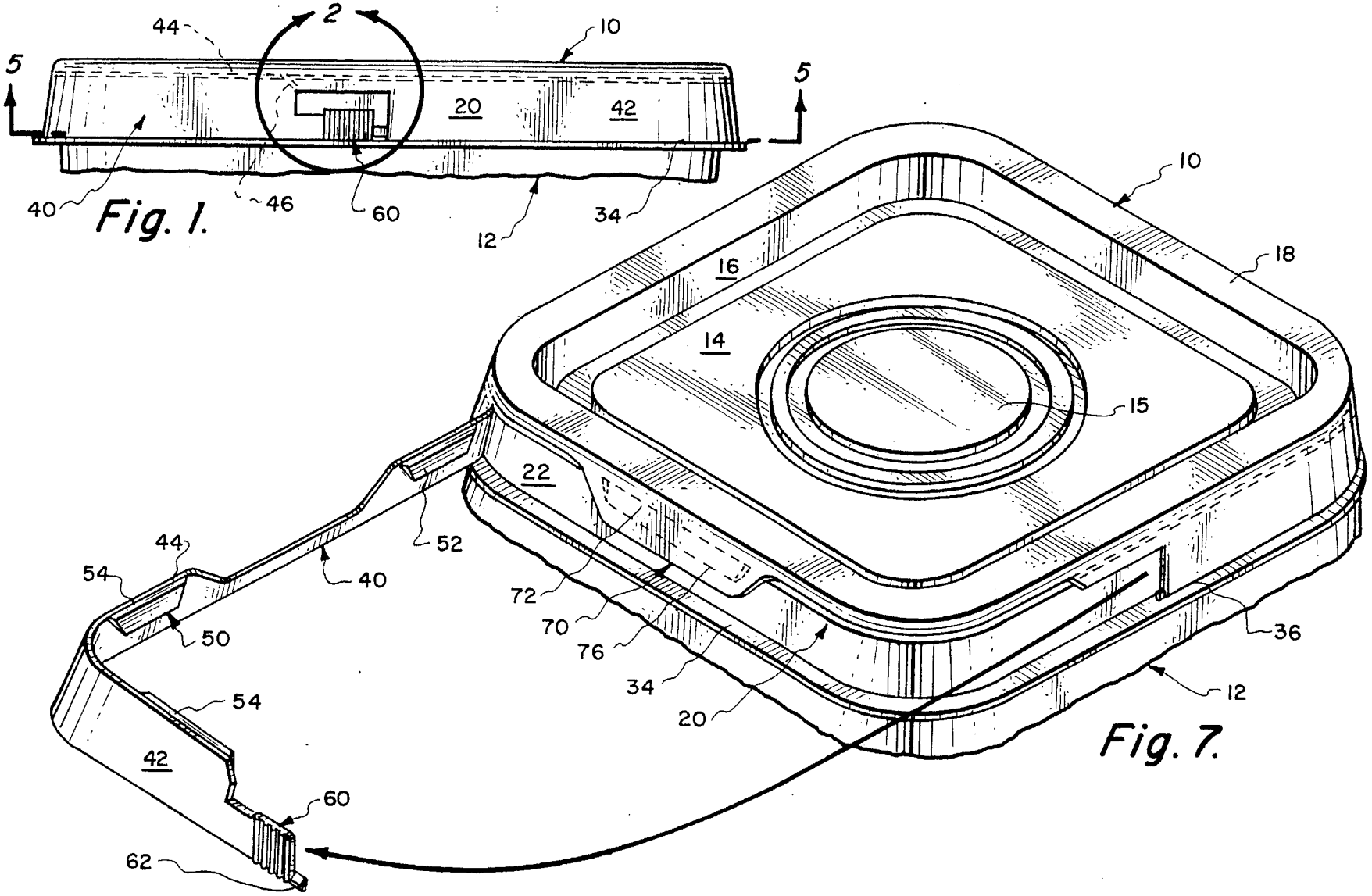
FIG. 1 is a fragmentary side elevational view showing the cover of the invention mounted upon the upper extremity of an associated container.
FIG. 7 is an isometric view illustrating the removal of the tear strip and associated primary detent means from operative engagement with the container and the retaining means thereof.
Figure 2:
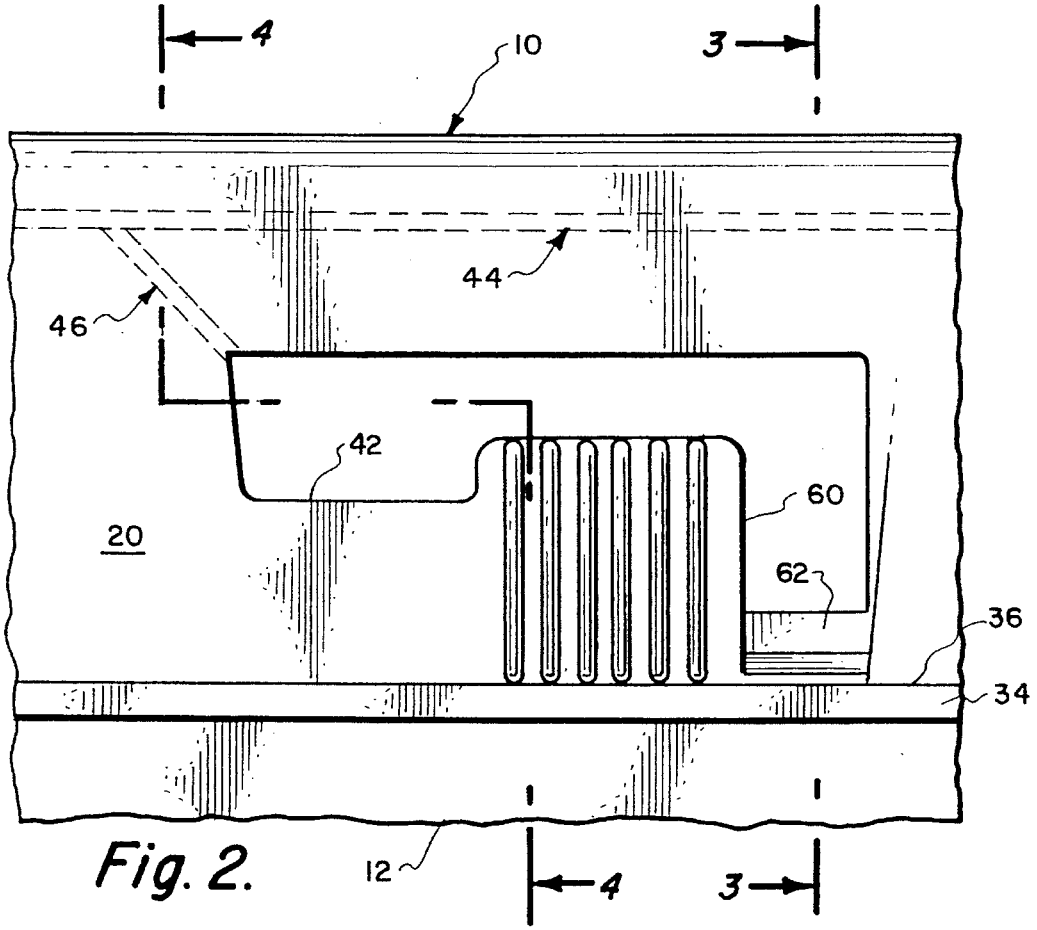
FIG. 2 is an enlarged fragmentary elevational view taken on the broken line 2 of FIG. 1.

Referring to the drawings, and particularly to FIGS. 1–2 and 7 thereof, I show a cover 10 of substantially square configuration adapted to be mounted upon the upper extremity of a container 12, said container being of correspondingly square configuration to the cover 10. The container and cover are fabricated from linear polyethylene but, of course, can be fabricated from other types of synthetic plastics and can also be fabricated from other materials such as aluminum and the like.

Figure 4:
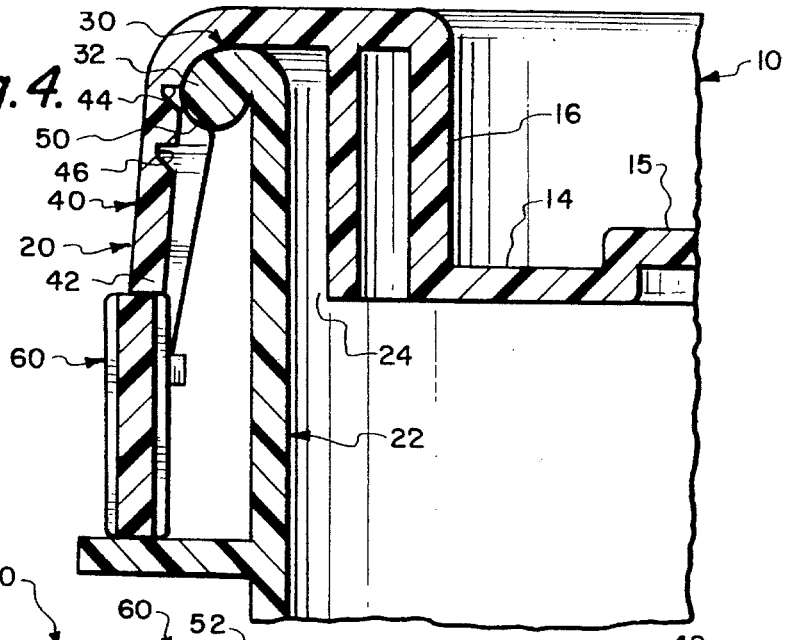
FIG. 4 is an enlarged fragmentary sectional view taken on the broken line 4—4 of FIG. 2.
Figure 5:
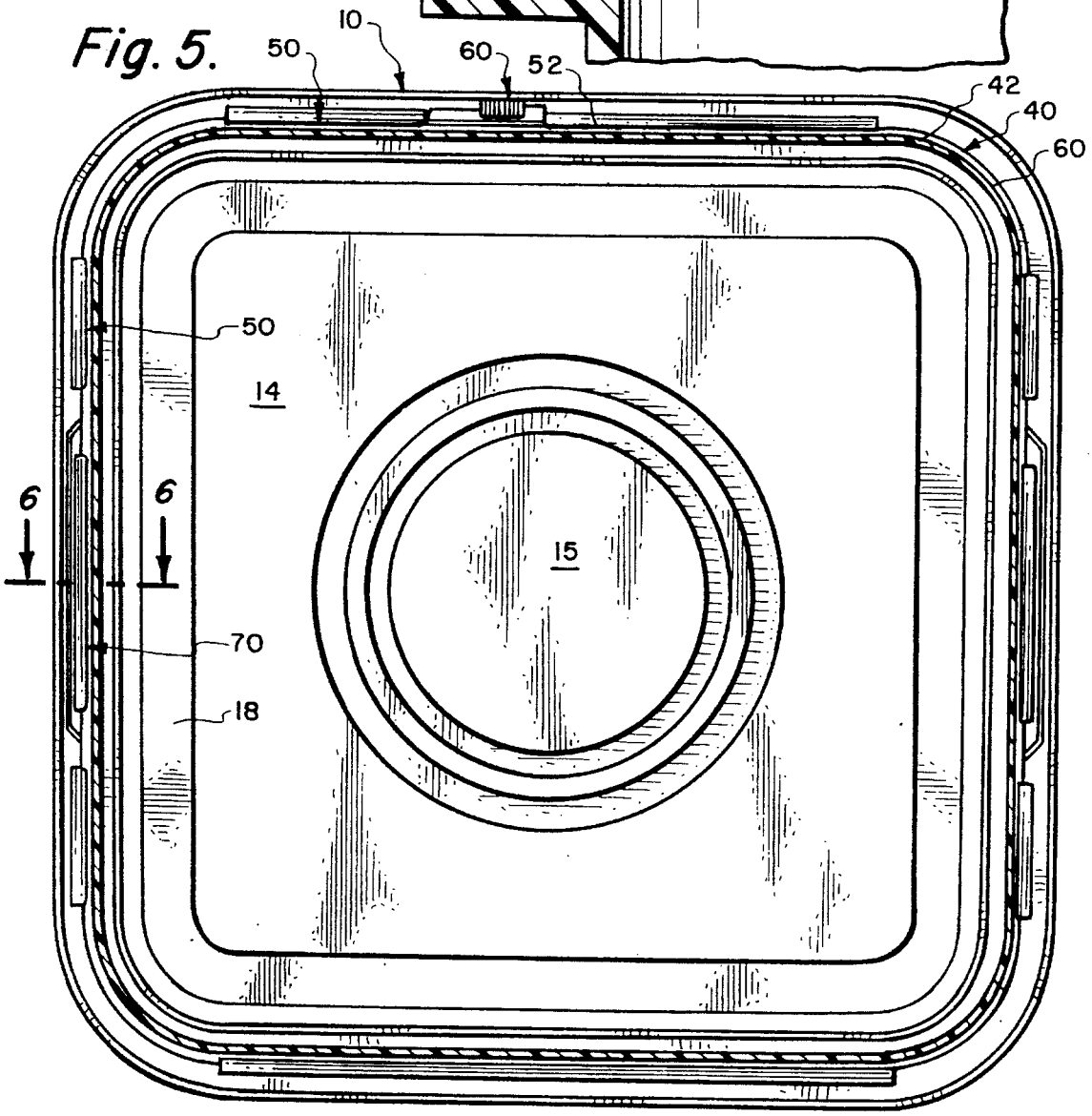
FIG. 5 is a transverse, partly-sectional view taken on the broken line 5—5 of FIG. 1.
Figure 8:
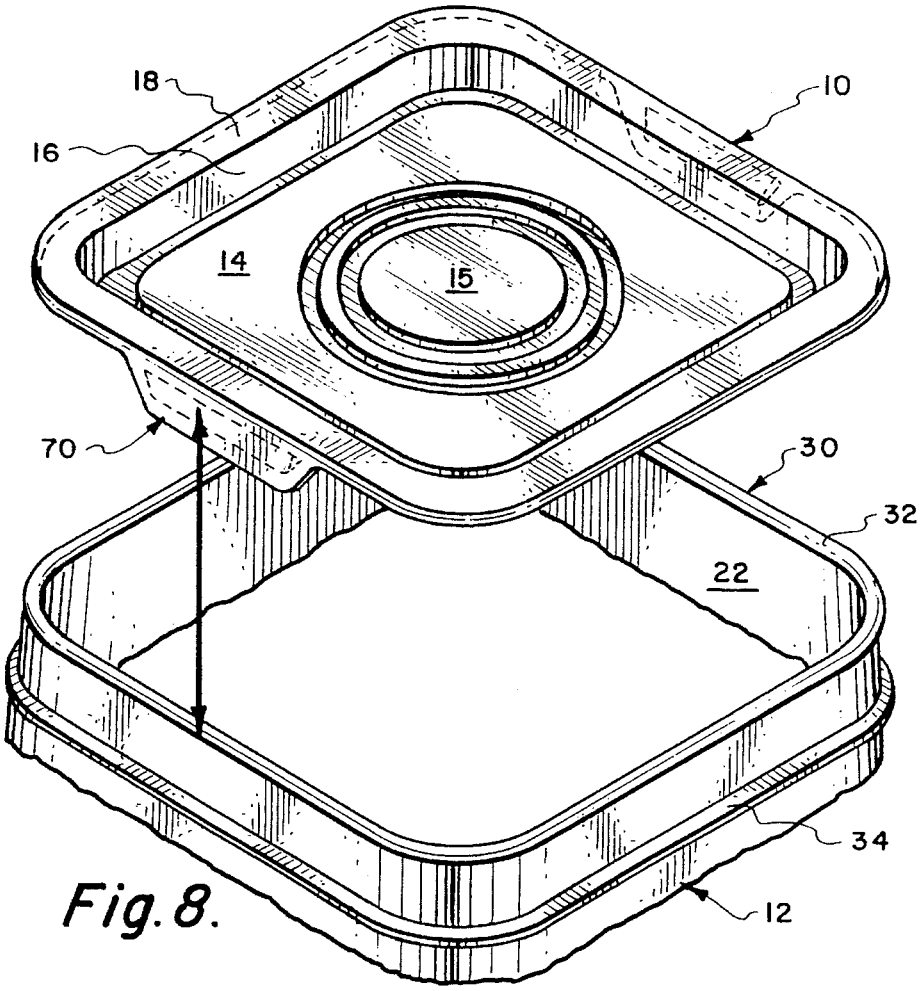
FIG. 8 is an enlarged, partially fragmentary view showing the cover as removed from the container.

The cover 10 is fabricated from linear polyethylene by injection molding and includes a centrally located web 14 having a pressure pad 15 thereupon for a purpose which will be described in greater detail below. Formed integrally with the web 14 is a vertical wall 16 connected to a horizontal flange 18 incorporating a depending external skirt 20 which encompasses the upper extremity of the container 12, said upper extremity 22 fitting within the substantially U-shaped cavity 24 defined between the vertical wall 16, horizontal flange 18, and depending external skirt 20. Formed integrally with the upper extremity 22 is a retaining means 30, FIG. 4, in the form of a cylindrically generated bead 32. The bead 32 extends completely around the perimeter of the extreme upper end of the upper extremity 22 of the container 12 for ease of injection molding but said bead could be provided in segments if desired or necessary.

Spaced downwardly from the bead 32 on the exterior of the upper extremity 22 of the container 12 is a right angularly projecting flange 34 upon the upper surface of which impinges the lower edge 36 of the skirt 20.

Incorporated in the skirt 20 is a first removable portion 40, said first removable portion 40 being in the form and function of a tear strip 42, said tear strip being initially fabricated integrally with the cover 10 but being defined at its upper extremity by a first score line 44 and a connecting score line 46.

Incorporated on the inner surface of the tear strip 42 adjacent the upper score line 44 are primary detent means 50 constituted by wedge-shaped portions 52 having lands 54 formed upon the upper surfaces thereof engagable with the corresponding portions of the bead 32.

When the tear strip 42 is in the initial condition on the container 12, as best shown in FIGS. 1 and 3–4 and 6 of the drawings, the primary detents 50 engage the underside of the bead 32 and provide for maximum securement of the cover 10 in operative relationship with the upper extremity 22 of the container 12.

A finger grip 60 is formed integrally with the tear strip 42 and is connected by a frangible link 62 to the opposite extremity of the tear strip, as best shown in FIG. 2 of the drawings. The upper score line 44 is connected by the angular score line 46 to the portion of the tear strip having the finger grip 60 provided thereupon. Therefore, the finger grip 60 is located in the conventional location customarily provided on prior art tear strips and the angular connecting score line 46 to the upper score line 44 permits the finger grip 60 to be grasped in a conventional manner while still removing the entire first portion 40 of the skirt 20 and, simultaneously, disengaging the primary detents 50 from operative engagement with the bead 32 of the cover retaining means 30 to facilitate the subsequent facile disengagement of the cover 10 from operative relationship with the upper extremity 22 of the container 12.

Figure 6:
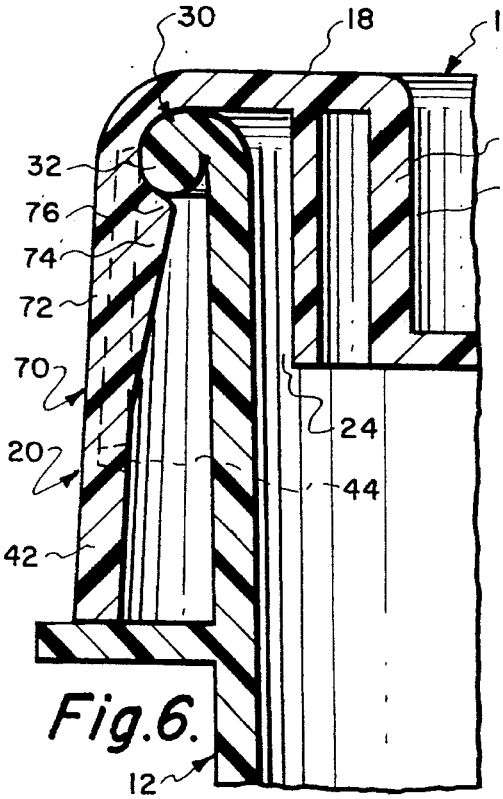
FIG. 6 is an enlarged fragmentary sectional view taken on the broken line 6—6 of FIG. 5.
Figure 3:
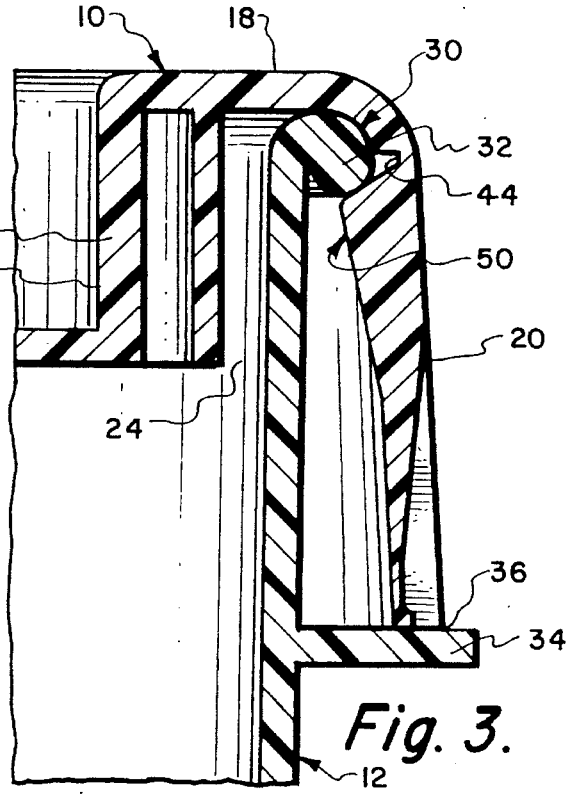
FIG. 3 is a vertical sectional view taken on the broken line 3—3 of FIG. 2.

The second portions 70 of the skirt 20 are in the form of depending detent tabs 72, said tabs, as best shown in FIG. 6 of the drawings, incorporating secondary detent means 74 constituted by wedge-shaped lands 76 engagable with the adjacent portions of the retaining bead 32. The perimeters of the detent tabs 72 are defined by the upper score line 44 and as the tear strip 42 is stripped or removed from operative engagement with the skirt, the score line 44 permits the tabs 72 to remain integral with the cover 10, as best shown in FIG. 7 of the drawings.

Consequently, after the tamper-evident tear strip 42 has been removed from its connection to the skirt 20, as graphically illustrated in FIG. 7 of the drawings, said removal being accompanied by the corresponding removal of the primary detent means 50, the secondary detent means 76 remain in engagement with the retaining means 30 of the container. In the present embodiment of the invention, two detent tabs 72 are provided in the skirt 20, but it will be obvious to those skilled in the art that any number of detent tabs 72 can be provided. However, the two tabs 72 suffice to maintain the cover 10 in operative relationship with the container 12 after the removal of the primary detent means on the tear strip 42.

However, the removal of the cover 10 from operative engagement with the container 12 is facilitated because the engagement of the detent tabs 70 with the retaining means 30 can be readily dislodged by gripping one of the tabs 70 and releasing it from operative engagement with the bead 32 by disengaging the secondary detent means 74 from the bead 32 and lifting the cover up which dislodges the corresponding detent tab 70 from its engagement with the other side of the container 12.

Figure 9:
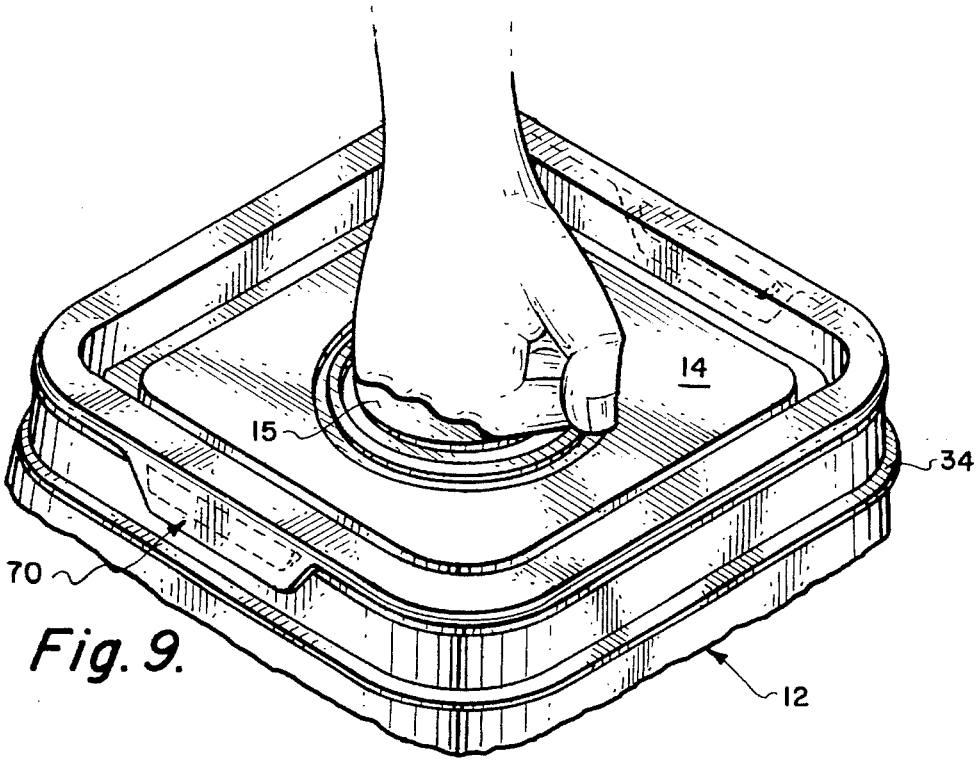
FIG. 9 is a view similar to FIG. 8 showing the cover being installed on the upper extremity of the container.

Correspondingly, when it is desired to replace the cover 10 on the container 12, it can be readily accomplished in the manner shown in FIG. 9 of the drawings wherein application of force to the pressure pad 15 causes the detent tabs 72 to snap in place immediately and the effort required for reinstallation of the cover 10 in operative relationship with the container 12 is greatly reduced.

Figure 10:
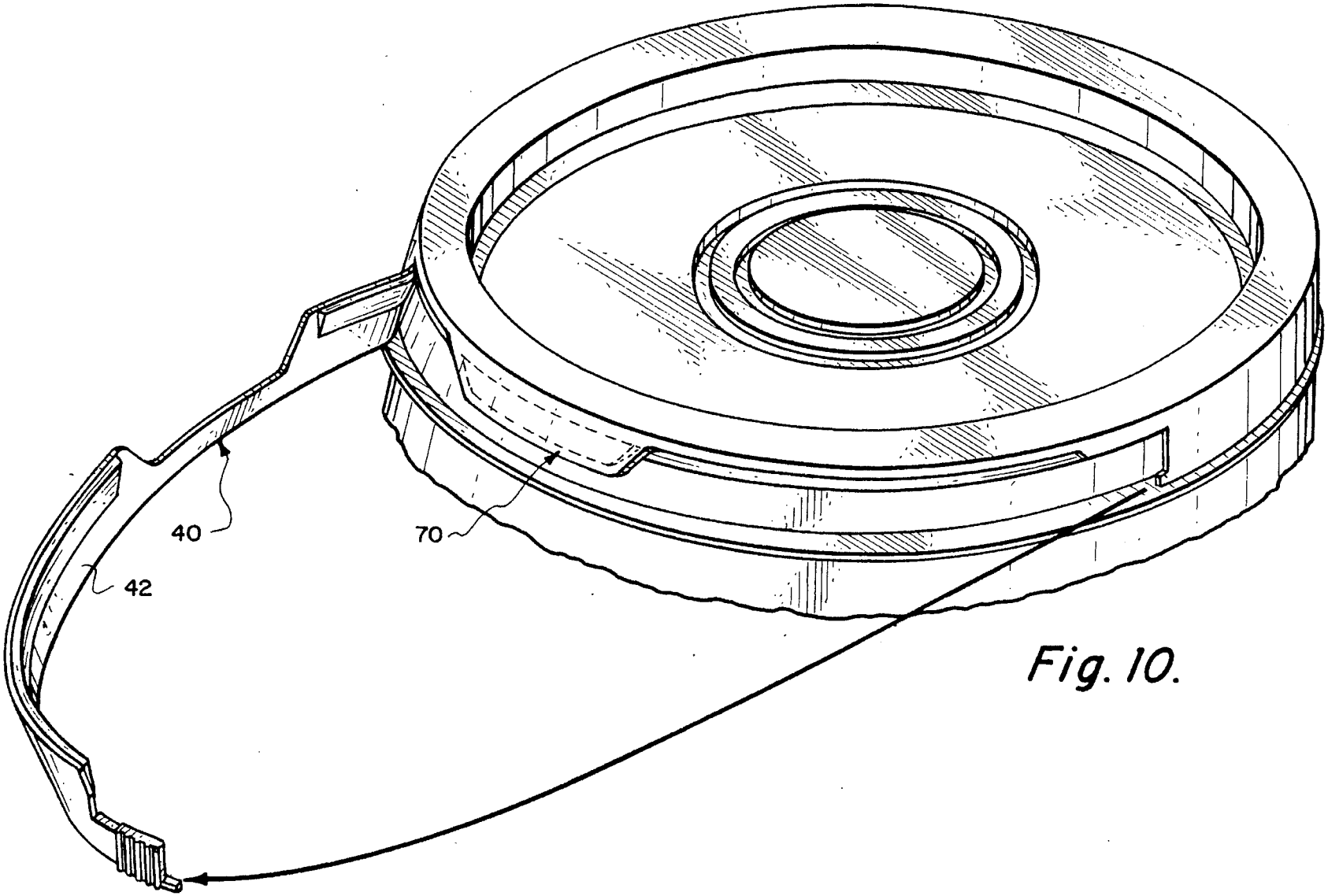
FIG. 10 is a view similar to FIG. 7 showing the teachings of the invention incorporated in a cylindrical rather than square container.

Obviously, as best shown in FIG. 10 of the drawings, the teachings of the invention can be applied with equal cogency to cylindrical or other configurations than the square container.

I thus provide by my invention a cover 10 for a container 12 which is characterized by the security of tamper-evident means in the form of a tear strip 42 provided in the skirt 20 of the cover. However, unlike conventional tear strips, the tear strip 42 incorporates primary detent means 50 engagable with the retaining means 30 of the cover and, when the tear strip 42 is removed, the primary detent means 50 are correspondingly removed from operative engagement with the cover retaining means 30.

After such removal, the secondary detent means incorporated in the detent tabs 70 which remain in operative relationship with the container 12 secure the cover 10 to the container 12, but facile removal of the cover is facilitated by the relatively limited engagement of the secondary detent means 74 of the detent tabs 32 with the associated retaining means 30 of the container 12.

Although I have described specific configurations and combinations of elements, it will be obvious to those skilled in the art that variations and substitutions can be made in the constructions and embodiments shown without departing materially from the teachings of the invention and the scope of the appended claims.

I claim:

1. A cover for a container having an opening and cover retaining means adjacent the opening, said cover including primary detent means engagable with the retaining means and secondary detent means engagable with the retaining means to maintain said cover in operative relationship with the container, said primary detent means being removable from said cover, the opening including one or more corners, said cover being configured in a shape corresponding to the opening including having one or more corresponding corners, said secondary detent means being peripherally spaced from said one or more corners of said cover.

2. The cover of claim 1 in which the container opening includes one or more relatively straight sides, said cover being configured in a shape corresponding to the opening including having one or more relatively straight sides, said cover including one or more tab members located along said straight sides and having said secondary detent means located thereon.

3. The cover of claim 1 in which spaced detent tabs are provided thereupon, said tabs incorporating said secondary detent means.

4. The cover of claim 1 or claim 2 in which said primary detent means is provided on a removable skirt portion of said cover.

5. A cover construction cooperative with a container having cover retaining means on its upper extremity including primary and secondary detent means engagable with said retaining means, said primary detent means being removable from operative relationship with said cover to facilitate the initial opening of said container by removal of said cover therefrom and said secondary detent means being engagable with said retaining means to facilitate reassembly of said cover with said container, in means being engagable with said retaining means to facilitate reassembly of said cover with said container, which the container includes an opening adjacent the upper thereof, the opening including one or more corners, said cover being configured in a shape corresponding to the opening including having one or more corresponding corners, said secondary detent means being peripherally spaced from said one or more corners of said cover.

6. The cover of claim 5 in which said primary detent means is provided on a tear strip whereby removal of said tear strip removes said primary detent means to facilitate the removal of said cover from said container while said secondary detent means remains in engagement with said retaining means.

7. The cover of claim 5 including downwardly extending spaced tabs incorporating said secondary detent means.

8. The cover of claim 5 which incorporates a tear strip encompassing the upper extremity of said container and having said primary detent means thereupon engagable with said retaining means to retain said cover in operative relationship with said container.

9. The cover of claim 8 in which said cover incorporates depending tabs with said secondary detent means thereupon, said tabs maintaining said cover in operative relationship with said container after said tear strip and said primary detent mean have been removed from operative relationship with said retaining means of said container.

10. A cover for a container, said cover including a centrally located web and a depending skirt for encompassing the upper extremity of the container, said depending skirt having primary detent means and secondary detent means engagable with corresponding retaining means on said container, said primary detent means being removable from said cover, in which the container includes an opening adjacent the upper extremity thereof, the opening including one or more corners, said cover being configured in a shape corresponding to the opening including having one or more corresponding corners, said secondary detent means being peripherally spaced from said one or more corners of said cover.

11. The cover of claim 10 in which said primary detent means is provided upon one portion of said skirt and said secondary detent means is provided on other portions of said skirt.

12. The cover of claim 11 in which said one portion of said skirt incorporating said primary detent means is removable from operative relationship with said cover.

13. The cover of claim 12 in which said other portions of said skirt are operatively connected to said cover after said one portion has been removed from said skirt.

14. The cover of claim 11 in which said one portion is a tear strip which serves as tamper indicating means for preventing removal of said cover without an indication of said removal.

15. The cover of claim 14 in which said other portions are constituted, by detent tabs for securing said cover to said container after the removal of said one portion from operative relationship with said cover.

* * * * *

UNITED STATES PATENT AND TRADEMARK OFFICE

CERTIFICATE OF CORRECTION

PATENT NO. : 5,617,968

DATED : April 8, 1997

INVENTOR(S) : Frano Luburic, Fullerton, Calif.

It is certified that error appears in the above-indentified patent and that said Letters Patent is hereby corrected as shown below:

Column 5, lines 18 - 20, in Claim 5, delete "means being engagable with said retaining means to facilitate reassembly of said cover with said container," after "in" and before "which".

Column 5, line 21, in Claim 5, insert --extremity-- between "upper" and "thereof".

Column 6, line 36, in Claim 15, cancel "," after "constituted".

Signed and Sealed this

Nineteenth Day of August, 1997

*Attest:*

Bruce Lehman

BRUCE LEHMAN

*Attesting Officer*

*Commissioner of Patents and Trademarks*